United States Patent [19]

Pratt, Jr. et al.

[11] 3,973,707

[45] Aug. 10, 1976

[54] STUFFED RIBBON CARTRIDGE

[75] Inventors: John W. Pratt, Jr., Kettering; David E. Filsinger, Dayton, both of Ohio

[73] Assignee: NCR Corporation, Dayton, Ohio

[22] Filed: Aug. 28, 1975

[21] Appl. No.: 608,807

[52] U.S. Cl. ..... 226/118; 197/151; 197/168

[51] Int. Cl.[2] ..... B65H 17/50; B41J 33/10

[58] Field of Search ..... 226/118; 206/389, 409; 197/151, 168

[56] References Cited

UNITED STATES PATENTS 3,543,983 12/1970 Dale ..... 226/118

3,758,012 9/1973 Bonner et al. ..... 226/118

*Primary Examiner*—John J. Love
*Assistant Examiner*—Robert Saifer
*Attorney, Agent, or Firm*—J. T. Cavender; Albert L. Sessler, Jr.; Elmer Wargo

[57] ABSTRACT

A spoolless ribbon cartridge containing a length of inked ribbon which is formed into an endless loop and stuffed into the cartridge to form a plurality of random convolutions or folds of ribbon therein. The cartridge has a specially-shaped ribbon storage compartment, in the general shape of a kidney, which compartment provides for a smooth flow of ribbon therethrough and enables a greater length of ribbon to be stored therein when compared to prior art cartridges.

17 Claims, 5 Drawing Figures

STUFFED RIBBON CARTRIDGE

BACKGROUND OF THE INVENTION

This invention relates to an improved, stuffed-ribbon cartridge for use in business machines.

A stuffed-ribbon cartridge is of the type which usually has about 15 yards of inked ribbon formed into an endless loop which is stuffed into the cartridge to form a plurality of random convolutions or folds of ribbon therein. The cartridge forms a means for supplying fresh ribbon to a print station in a business machine in which the cartridge is used and for quickly changing the ribbon in the machine without ever having to manipulate or touch the ribbon by hand.

Some ribbon cartridges representative of the prior art shown in the U.S. Pat. Nos. 3,758,012, 3,814,231, 3,830,351 and 3,863,749.

One of the problems with prior art ribbon cartridges is that the strand of ribbon exiting from the exit area of the cartridge will drag therewith several convolutions of ribbon. If enough convolutions of ribbon jam up at the exit area, the exit area can become clogged, causing the tension on the ribbon being pulled out of the cartridge to increase, resulting in possible fraying or breaking of the ribbon.

Another problem with prior art cartridges is that very often, the particular fold or convolution of ribbon which is being pulled out of the exit area of the ribbon storage compartment is connected to some folds of ribbon which are located at the entrance area of the compartment due to the random stuffing of the ribbon therein, thereby placing the ribbon being pulled out of the exit area under an undue amount of tension which also causes fraying or breaking of the ribbon.

The cartridge of the present invention obviates the problems mentioned in the previous paragraph in that it has a specially designed storage compartment not shown in the prior art which facilitates the flow of the ribbon therethrough. The storage compartment is in the general shape of a kidney, and its particular design enables the folds of the ribbon being stuffed into the compartment to flow smoothly around an outer curved wall of the compartment and then approach the exit area of the compartment. By this construction, those folds of the ribbon which are to be exited from the compartment are located close to the exit area thereof; and consequently, the tension on the ribbon which is being exited from the compartment is considerably less than what it is on prior art constructions. As a result, the length of ribbon which can be stored in the compartment in the illustrated embodiment of the invention is about 22 to 25 yards compared to comparable prior art cartridges which store about 16 yards of ribbon.

SUMMARY OF THE INVENTION

This invention relates to a ribbon cartridge of the stuffed-ribbon variety having a ribbon storage compartment with entrance and exit areas therein; ribbon feed means for pulling the ribbon out of said exit area and feeding it into the entrance area of the compartment, and ribbon guide means for guiding the ribbon past a print station. The storage compartment is generally kidney-shaped and has a floor portion with first and second walls upstanding therefrom, with the first and second walls diverging away from each other at the entrance area and converging towards each other at the exit area. The first wall is formed into a continuous curve having radii of curvature which decrease in length from the entrance area to a minimum at approximately a midpoint in the length of the wall. The second wall is formed into a continuous curve having radii of curvature which increase in length from the entrance area to a maximum between the ends thereof and then decrease in length to a minimum near the exit area. A cover, common to both the ribbon storage compartment and ribbon guide means, retains the ribbon in the cartridge.

BRIEF DESCRIPTION OF THE DRAWINGS

The advantages and features of this invention will be more readily understood from the following description and drawings in which.

DETAILED DESCRIPTION OF THE INVENTION

Figure 1:
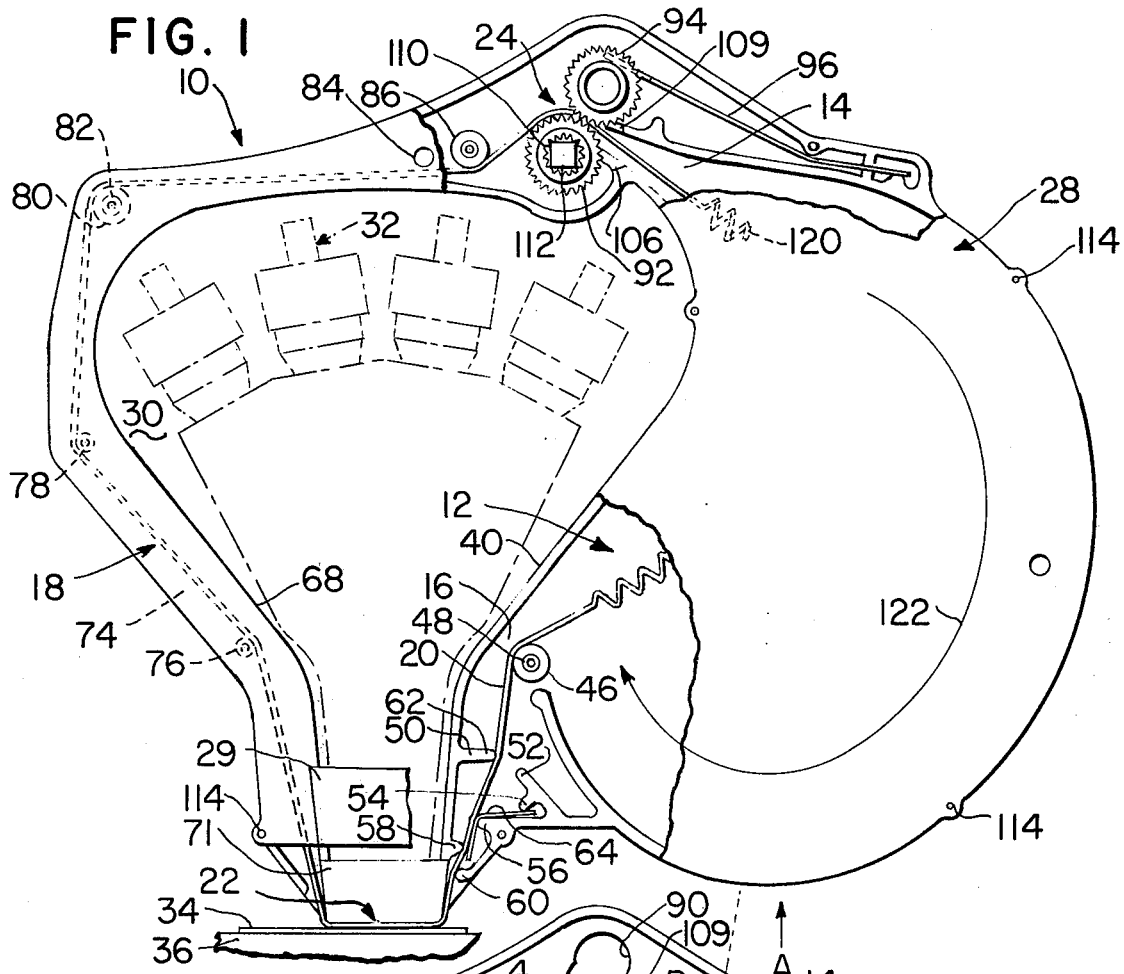
FIG. 1 is a top plan view of a ribbon cartridge embodying the principles of this invention, showing its relation to a print head and platen of a utilization device like a printer in which the cartridge may be used, with a cover on the cartridge being partially broken away to expose the path of a ribbon being fed through the cartridge.

FIG. 1 is a plan view of a ribbon cartridge designated generally as 10 and made according to the teachings of this invention. The cartridge 10 includes a ribbon storage compartment 12 having an entrance area 14 and an exit area 16 therein as shown. The cartridge 10 also includes a ribbon guiding section designated generally as 18 which is used to guide a ribbon 20 from the exit area 16, around a print station 22, and to return the ribbon to a ribbon feed means 24 located near the entrance area 14. The feed means 24 pulls the ribbon 20 out of the exit area 16 and pushes it into the entrance area 14 of the storage compartment 12. The cartridge 10 has a body portion designated generally as 26 and a cover designated generally as 28. The body portion 26 has an open area 30 therein to receive a print head 32 shown in phantom outline in FIG. 1 when the cartridge 10 is used with a utilization device like a printer, with only a record medium 35 and platen 36 thereof also being shown.

Figure 2:
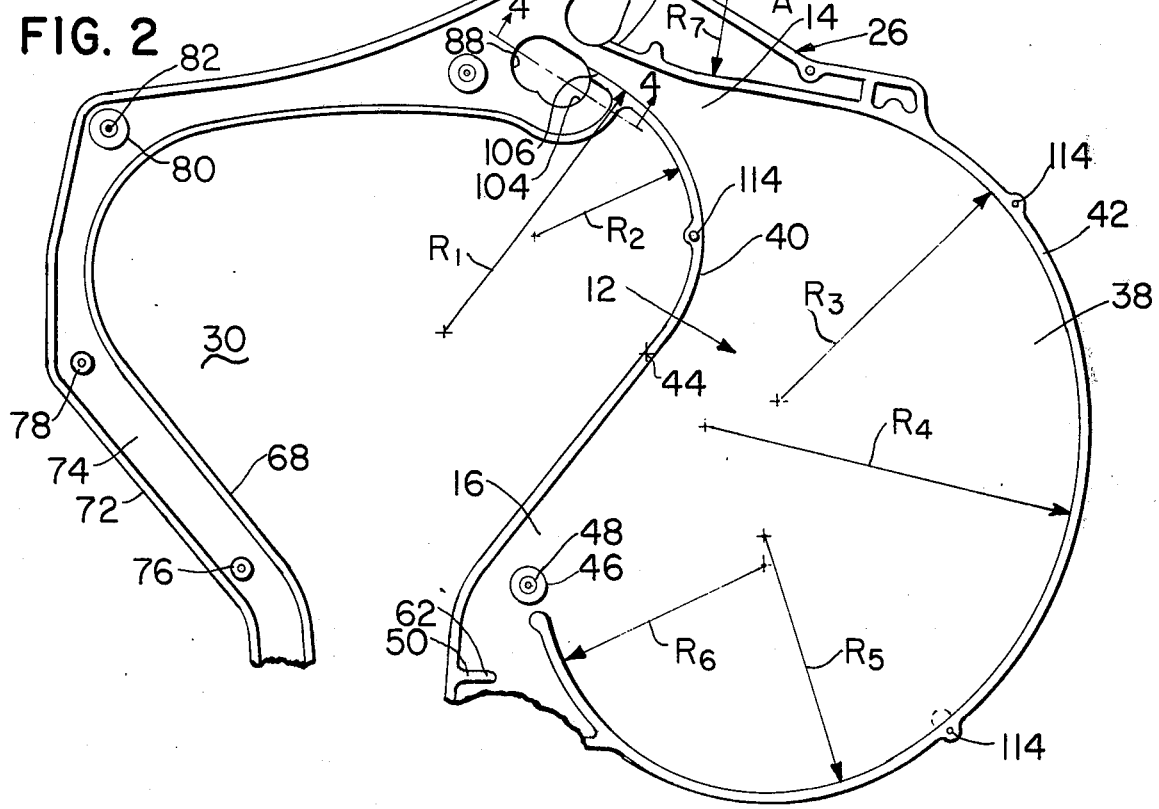
FIG. 2 is a plan view of the body of the cartridge shown in FIG. 1 with the cover removed to show the specific shape of a storage compartment in which the convolutions or folds of a ribbon are stored.
Figure 3:
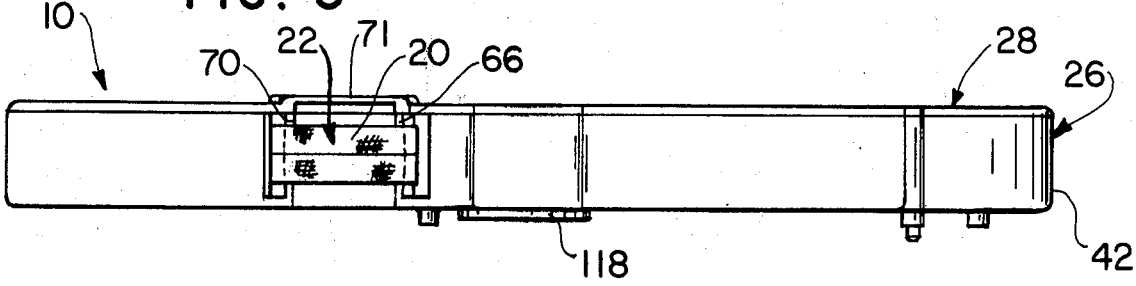
FIG. 3 is a front view, in elevation, of the cartridge of this invention as viewed from the direction of arrow A in FIG. 1.

The body portion 26 has the general shape shown in FIGS. 1, 2, and 3, which figures are shown accurately to scale. The ribbon storage compartment 12 of the body portion 26 is comprised of a floor portion 38 with a first wall 40 and a second wall 42 perpendicularly upstanding therefrom as shown. The first and second walls 40 and 42 diverge away from each other at the entrance area 14 and converge towards each other at the exit area 16 of the compartment 12, and are sufficiently high to enable the width of the ribbon 20 to freely pass therethrough.

The first wall 40 of the compartment 12 is formed into a continuous curve having radii of curvature which decrease in length from a maximum radius $R_1$, at the entrance area 14 to a minimum radius $R_2$ at a midpoint 44 located approximately along the length of the wall between the entrance and exit areas 14 and 16 respectively. From the midpoint 44 to the exit area 16, the first wall 40 is formed into a substantially straight line.

The second wall 42 of the compartment 12 is formed into a continuous curve having a plurality of radii of curvature which increase in length from a first radius $R_3$ located near the entrance area 14 to a maximum radius $R_4$ between the ends of the wall 42, and thereafter, the radii of curvature $R_5$, $R_6$ decrease in length to a minimum, as at radius $R_6$ near the exit area 16. In developing a portion of the second wall 42, $R_4$, the maximum radius of curvature, becomes perpendicular at one position to the straight portion of the first wall 40. The second wall 42 also has a slight reverse bend formed therein by a radius of curvature $R_7$, located near the entrance area 14. The centers of the radii $R_1$–$R_2$ are located on one side of an imaginary straight line drawn between the entrance and exit areas 14 and 16, and the radii $R_3$–$R_7$ are located on the opposite side of the line. The following are the dimensions in inches of the radii of curvature of one embodiment of this invention:

| Radius | Length (inches) |
|---|---|
| $R_1$ | 2.00 |
| $R_2$ | 1.13 |
| $R_3$ | 2.00 |
| $R_4$ | 2.50 |
| $R_5$ | 1.69 |
| $R_6$ | 1.50 |
| $R_7$ | 2.00 |

The flow of the ribbon 20 through the compartment 12 will be described later herein; however it seems appropriate to continue the description of the body portion 26 which has the ribbon guiding section 18 attached thereto. The guiding section 18 includes a roller 46 which is rotatably mounted on a pin 48 upstanding from the floor portion 38, and also includes vertically upstanding wall sections 50, 52, 54, 56, 58 and 60, as are best shown in FIG. 1. Each of these wall sections has an exposed chamfered edge as at 62 on wall section 50 for example, to facilitate the smooth flow of the ribbon 20 therearound. A planar metal spring 64, formed into a generally "L"-shaped configuration, has one end retained by wall section 54 and the remaining end thereof is resiliently biased against the wall section 58 to resiliently compress the ribbon 20 thereagainst to provide tension on the ribbon 20 as it is withdrawn from the compartment 12. An extension of first wall 40 terminates in a chamfered edge 66 (FIG. 3) around which the ribbon 20 passes at the print station 22.

The body portion 26 also includes an inner wall 68 which terminates in a chamfered edge 70 (FIG. 3) around which the ribbon 20 passes. The chamfered edges 66, 70 (FIG. 3) which are spaced apart in parallel relationship provide the means for supporting the ribbon 20 at the print station 22. A joining bar 71 is integrally formed with the ends of the walls 68 and 40 at the print station 22 to reinforce the cartridge 10. The inner wall 68 and an outer wall 72 provide a channel for the ribbon 20 to be guided in the cartridge 10, as is best shown in FIG. 1. The walls 68 and 72 are vertically upstanding from a floor portion 74 which is integrally formed with the floor portion 38. From the chamfered edge 70 at the print station 22, the ribbon 20 passes around guide pins 76, 78 upstanding from the floor portion 38 and also passes around a roller 80, rotatably mounted on a pin 82 upstanding from the floor portion 74. From the roller 80, the ribbon passes around a pin 84 and roller 86 (similar to roller 80) and is fed into the compartment 12 by the ribbon feed means 24. The body portion 26 has two elongated holes 88 and 90 (FIG. 2) therein for use in mounting the ribbon feed means 24.

Figure 5:
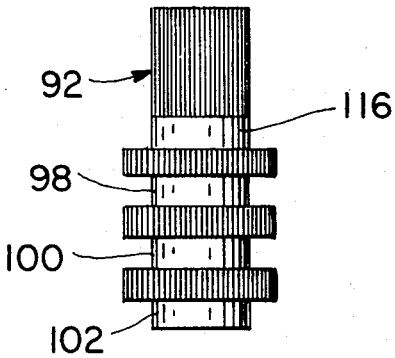
FIG. 5 is a side view, in elevation, of a feed wheel used in the ribbon feed means.
Figure 4:
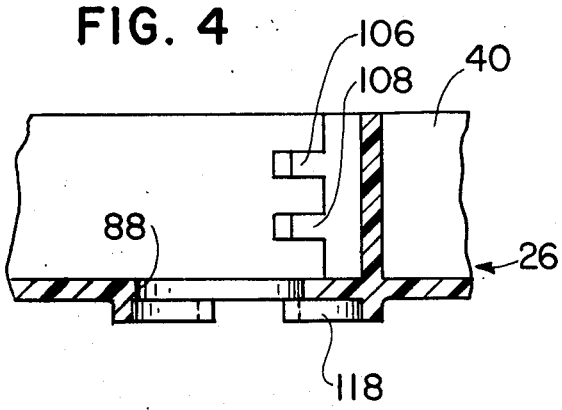
FIG. 4 is a cross-sectional view, taken along the line 4—4 of FIG. 2, to show a means for supporting a gear type ribbon feed means which is used to feed the ribbon through the storage compartment.

The ribbon feed means 24 (FIG. 1) includes a knurled drive wheel 92 and an idler drive wheel 94 which is resiliently biased into engagement with the drive wheel 92 by a leaf spring 96. Each of the wheels 92, 94 has the shape shown in FIG. 5 and has two annular recesses 98 and 100 formed therein as shown, and a diameter portion 102 which is rotatably received in a mating portion 104 of the associated hole (88,90) in the floor portion 74 of the body portion 26 of the cartridge 10. The drive wheel 92 is also rotatably supported by two fingers 106 and 108 (FIG. 4) which extend from the first wall 40 and are inserted into the annular recesses 98,100 of the drive wheel 92 when the ribbon feeding means 24 is in the assembled relationship shown in FIG. 1. The driven wheel 94 is similarly supported by fingers 109 (similar to fingers 106, 108) in the second wall 42 and fingers (not shown) in the leaf spring 96. The drive wheel 92 is tubular and has axially extending splines 110 therein to enable the wheel 92 to be driven, as for example, by a square shaft 112 which is associated with the printer with which the cartridge 10 is used. When the shaft 112 is driven in a clockwise direction, as viewed in FIG. 1, the wheels 92 and 94 pull the ribbon 20 from the exit area 16 of the compartment 12 and push it into the entrance area 14 thereof.

After the ribbon 20 is installed in the cartridge 10, the cover 28 is placed over the body portion 26 to seal the ribbon therein. The body portion 26 has suitable pins like 114 extending from the various walls like 40, 42 and 72, and pins like 48, 82 for example which mate with complementary holes in the cover 28 to secure it to the body portion 26 to retain the ribbon 20 in the cartridge 10. There are also mating holes (not shown) in the cover 28 to rotatably receive the diameter portion 116 (FIG. 5) of the associated wheels 92, 94. The cover 28 has a reinforcing section 29 near the print station 22, to join the sections of the cover 28 between the walls 68, 72 and the first wall 40 of the body portion 26. There is no portion of the cover extending over the opening 30 in the body portion 26. The body portion 26 also has an annular flange 118 (FIGS. 3, 4) to help locate the cartridge 10 with reference to the printer on which it is mounted.

The operation of the cartridge 10 when installed on the printer is as follows. As a fresh supply of inked ribbon is needed in the printer, the square shaft 112 is rotated in a clockwise direction (as viewed in FIG. 1) by drive means associated with the printer, and a length of ribbon 20 is pulled out of the exit area 16 and is pulled past the print station 22 and fed into the entrance area 14 of the compartment 12. The wheels 92 and 94 tend to fold the ribbon between the axially aligned knurls or ridges on these wheels, and the folds 120 produced thereby are pushed into the entrance area 14 of the compartment 12.

The design of the compartment 12 enables the folds 120 of the ribbon 20 to follow the general route outlined by the arrow 122 in FIG. 1 in travelling from the entrance area 14 to the exit area 16, so that the folds of ribbon which are next to leave the compartment 12 are located near the exit area 16 thereof, thereby providing a low tension on the ribbon and permitting a larger length of ribbon (formed into an endless loop) to be stored therein when compared to prior art devices. The width of the entrance area 14 near the ribbon feed means 24 controls the length of the ribbon folds 120. The near parallel nature of the first and second walls 40, 42 near the ribbon feed means 24 forces the folds 120 to stack neatly, one against or upon another. When the stack of folds 120 achieve a length of two to three times the initial width of the entrance area 14 near the ribbon feed means 24, the first and second walls 40, 42 have diverged sufficiently away from each other to permit the stack of folds 120 to break and fold over to form a bundle. The bundles so formed then tend to flow more or less as a unit toward the exit area 16 along the general direction of arrow 122, with a greatly reduced tendency for adjacent lengths of ribbon to string out and become trapped. Continued divergence of the first and second walls 40, 42 away from each other relieves the pressure buildup in the entrance area 14 and enables a large volume of ribbon to be stored in the cartridge 10. Generally 22–25 yards of ribbon can be stored in the cartridge 10 of this invention whereas only about 16 yards of ribbon can be stored in cartridges of the prior art.

The initial application for which the cartridge 10 was designed was one which dictated that the ribbon 20 be supported in a horizontal plane at the print station 22, and it was felt that some of the success of the cartridge in providing trouble-free operation was due to the fact that gravity helped the flow of the ribbon 20 from the entrance area 14 to the exit area 16 of the compartment 12. However, when the cartridge 10 was utilized in an application in which the ribbon 20 was supported in a vertical plane at print station 22, the same trouble-free results were obtained, thereby indicating that it was the design of the compartment itself which provided the trouble-free operation.

The body portion 26 and the cover 28 may be made from high impact polystyrene material and may be formed by conventional injection molding techniques.

What is claimed is:

1. A ribbon cartridge comprising a ribbon storage compartment having an entrance area for receiving a ribbon and an exit area through which the ribbon passes to a utilization device;

said storage compartment comprising a floor portion having a first wall and a second wall upstanding from said floor portion with said first and second walls diverging away from each other at said entrance area and converging towards each other at said exit area;

said second wall being formed into a continuous curve having radii of curvature which increase in length from said entrance area to a maximum between the ends of said second wall and then decrease in length to a minimum near said exit area; and said first wall being formed into a continuous curve having radii of curvature which decrease in length from said entrance area to a minimum at approximately a midpoint in the length of said first wall.

2. The cartridge as claimed in claim 1 in which the centers of all of said radii of curvature of said first wall are located on one side of an imaginary line between said entrance and exit areas, and in which the centers of all of said radii of curvature of said second wall are all located on the opposite side of said imaginary line.

3. The cartridge as claimed in claim 1 in which the centers of all of said radii of curvature of said first wall lie outside said ribbon storage compartment and the centers of all said radii of curvature of said second wall lie within said ribbon storage compartment, and in which said first wall is substantially straight between said midpoint therein and said exit area.

4. The cartridge as claimed in claim 1 further including an endless ribbon stored in said storage compartment.

5. A ribbon cartridge of the stuffed-ribbon variety, comprising a ribbon storage compartment having an entrance area for receiving a ribbon and an exit area through which the ribbon passes to a utilization device;

said storage compartment comprising a floor portion having a first wall and a second wall upstanding from said floor portion, which said first and second walls diverge away from each other at said entrance area and converge towards each other at said exit area;

said second wall being formed into a continuous curve having a plurality of radii of curvature in which the radii increase from a first radius of curvature near said entrance area to a maximum at a second radius of curvature at about a midway point along the length of said second wall and then the radii decrease to a third radius of curvature near said exit areas;

said first wall being formed into a continuous curve having radii of curvature in which the radii decrease from a first radius of curvature at said entrance area to a second radius of curvature at approximately a midway point between said entrance and exit areas, with said first wall having a relatively straight portion between its said midway point and said exit area;

said second wall having an end portion which if extended would intersect said first wall at said exit area; and a cover extending between said first and second walls to retain a ribbon in said storage compartment.

6. The cartridge as claimed in claim 5 in which the centers of all of said radii of curvature of said first wall are located on one side of an imaginary line between said entrance and exit areas; and in which the centers of all of said radii of curvature of said second wall are all located on the opposite side of said imaginary line.

7. The cartridge as claimed in claim 6 in which said centers of all of said radii of curvature of said first wall lie outside said ribbon storage compartment and said centers of said first, second, and third radii of curvature of said second wall lie within said ribbon storage compartment.

8. The cartridge as claimed in claim 5 in which said first radius of said second wall has a length equal to R, and said second and third radii of curvature of said second wall have lengths approximately equal to 2.25R and 0.75R respectively, and said first and second radii of curvature of said first wall have lengths approximately equal to R and 0.50R, respectively.

9. The cartridge as claimed in claim 8 in which the centers of said radii of curvature of said first wall lie outside said ribbon storage compartment, and the centers of said first, second and third radii of curvature of said second wall are located within said ribbon storage compartment.

10. The cartridge as claimed in claim 6 in which said second wall has an imaginary point thereon which also lies on said second radius of curvature of said second wall when this last named radius is perpendicular to said straight portion of said first wall.

11. A ribbon cartridge of the stuffed ribbon variety comprising:

a body having a ribbon storage compartment and a ribbon guiding portion;

said ribbon storage compartment having an entrance area and an exit area;

ribbon feed means at said entrance area for withdrawing ribbon from said exit area, pulling it through said ribbon guiding portion, and feeding it into said ribbon storage compartment;

said ribbon storage compartment comprising a floor portion having a first wall and a second wall upstanding therefrom with said first and second walls diverging away from each other at said entrance area and converging towards each other at said exit area;

said second wall being formed into a continuous curve having radii of curvature which increase in length from said entrance area to a maximum between the ends thereof and then decrease in length to a minimum near said exit area; and said first wall being formed into a continuous curve having radii of curvature which decrease in length from said entrance area to a minimum at approximately a midpoint in the length of said first wall;

said ribbon guiding portion also being shaped to receive a print head; and a cover extending over said ribbon storage compartment and said ribbon guiding portion.

12. The cartridge as claimed in claim 11 in which the centers of all of said radii of curvature of said first wall lie outside of said ribbon storage compartment and the centers of all said radii of curvature of said second wall lie within said ribbon storage compartment; and in which said first wall is substantially straight between said midpoint therein and said exit area.

13. The cartridge as claimed in claim 12 in which said ribbon guiding portion has spaced apart third and fourth walls for guiding a ribbon from said exit area to said entrance area.

14. The cartridge as claimed in claim 13 further including an endless ribbon within said cartridge with said ribbon having folds therein, which said folds are formed at said entrance area, and move towards said exit area generally along said second wall to be exited therefrom; said folds which are to be exited from said exit area being located adjacent to said exit area.

15. A ribbon cartridge comprising:

a body portion having an opening therein to receive a printing means;

a compartment having an endless ribbon therein and also having ribbon entrance and exit areas therein;

a ribbon guiding section for guiding said ribbon from said exit area to said entrance area and including a print station for supporting said ribbon for cooperative printing action with said printing means;

ribbon feed means for pulling said ribbon out of said exit area and feeding it into said entrance area;

said compartment being positioned adjacent to said opening and being generally kidney-shaped to facilitate the movement of said ribbon therethrough.

16. The cartridge as claimed in claim 15 in which said compartment comprises a floor portion having first and second walls upstanding therefrom and a cover thereover;

said first wall being formed into a continuous curve having radii of curvature which decrease in length from said entrance area to a minimum at approximately a midpoint in the length of said first wall; and said second wall being formed into a continuous curve having radii of curvature which increase in length from said entrance area to a maximum between the ends of said second wall and then decrease in length to a minimum near said exit area.

17. The cartridge as claimed in claim 16 in which the centers of all of said radii of curvature of said first wall are located on one side of an imaginary line between said entrance and exit areas, and in which the centers of all of said radii of curvature of said second wall are all located on the opposite side of said imaginary line.

* * * * *